US006307506B1

(12) United States Patent
Despain

(10) Patent No.: US 6,307,506 B1
(45) Date of Patent: Oct. 23, 2001

(54) METHOD AND APPARATUS FOR ENHANCING THE DIRECTIONAL TRANSMISSION AND RECEPTION OF INFORMATION

(75) Inventor: Alvin M. Despain, Los Angeles, CA (US)

(73) Assignee: Acorn Technologies, Inc., Pacific Palisades, CA (US)

( * ) Notice: Subject to any disclaimer, the term of this patent is extended or adjusted under 35 U.S.C. 154(b) by 0 days.

(21) Appl. No.: 09/420,058

(22) Filed: Oct. 18, 1999

(51) Int. Cl.[7] ..... H01Q 3/22
(52) U.S. Cl. ..... 342/368; 342/375
(58) Field of Search ..... 342/368, 372, 342/373, 375

(56) References Cited

U.S. PATENT DOCUMENTS

| | | | | |
|---|---|---|---|---|
| 4,140,022 | | 2/1979 | Maslak . | |
| 4,290,127 | | 9/1981 | Pridham et al. . | |
| 4,896,336 | * | 1/1990 | Henely et al. | 375/80 |
| 5,357,962 | * | 10/1994 | Green | 128/660.07 |
| 5,573,001 | * | 11/1996 | Petrofsky et al. | 128/661.01 |
| 6,032,028 | * | 2/2000 | Dickey et al. | 455/110 |

* cited by examiner

*Primary Examiner*—Dao Phan
(74) *Attorney, Agent, or Firm*—Robert E. Malm

(57) ABSTRACT

The invention is a method and apparatus for (1) enhancing the transmission of information in a particular direction or (2) enhancing the reception of information from a particular direction by an array of transducers, a transducer being any device for transforming radiated power into electrical power and vice versa. A transducer signal is associated with each transducer in an array, the plurality of transducer signals being the vehicle for transmitting or receiving information. Each transducer signal is the sum of a first product and a second product. The first product is the product of a first signal and a cosine function of an argument. The second product is the product of a second signal and a sine function of the same argument. An argument is the sum of a phase and a product of an angular frequency and time. The bandwidths of the first and second signals are less than half a reference frequency W, and the angular frequency of the sine and cosine functions is greater than $2\pi$ times the reference frequency. The method comprises the steps of (1) adjusting the arguments of the sine and cosine functions and (2) adjusting an embedded time reference in the first and second signals with respect to a real-time reference.

33 Claims, 3 Drawing Sheets

METHOD AND APPARATUS FOR ENHANCING THE DIRECTIONAL TRANSMISSION AND RECEPTION OF INFORMATION

CROSS-REFERENCE TO RELATED APPLICATIONS (Not applicable)

STATEMENT REGARDING FEDERALLY SPONSORED RESEARCH AND DEVELOPMENT (Not applicable)

BACKGROUND OF THE INVENTION

The present invention relates to signal processing techniques to form beams applicable to radar and communication systems. More specifically, the present invention relates to methods and apparatus for introducing phase and time delays in a general class of signals composed of a modulated carriers that are applicable to the formation of directive transmission and reception patterns for arrays of antennas and other types of transducers.

Modem communication, radar, and related systems often utilize arrays of spatially separated antennas, or more generally, transducers, to enhance transmission and reception of signals from particular directions. Arrays are used to produce directive patterns, to place nulls in the directions of interfering signals, and to allow directive arrays to adapt to other environmental effects.

Mathematically, the spatial reception directivity afforded by arrays is accomplished by generating a weighted summation of the signals received by the individual antennas/transducers in the array. The spatial transmission directivity is accomplished by individually weighting a common carrier signal transmitted by each array element. Appropriate weighting can produce tightly confined regions of enhanced transmission and reception referred to as beams. In practice, one of two principle implementations have generally been employed for array beamforming: phased arrays and true time-delay arrays.

In phased arrays, phase-shifting units are inserted between the antennas that constitute the array and a summation junction where the individual signals received by the antennas are combined. The phase-shifting units, or simply phase shifters, produce a selectable phase shift in the transmitted and/or received signals. For narrowband signals, appropriate phase shifts can be found that will allow the formation and steering of a beam to any desired location within the constraints of the array topology. Wideband signals cannot be effectively formed into narrow beams by phased array antenna systems. The frequency range inherent in the wideband signal produces a degradation in the beamwidth and an increase in sidelobes.

Generally, for wideband signals, a true time-delay array is required. In a true time-delay array, a variable time-delay unit is inserted between the antennas and the common junction. Ideally the time-delay unit exactly matches the time delays needed to launch a beam at a desired angle and for reception, cancels the differential time delay of the signal incident on the array. By appropriate selection of the time delay imposed on each antenna signal, a beam can be steered to any desired angular location within the constraints of the array topology. Implementation of true time-delay arrays, or more particularly, the required time-delay units, often results in a system that is prohibitively expensive and/or complex.

Consider a signal s(t) 14 emitted by a distant source and incident with angle θ on an array of spatially separated antennas 0, 1, 2, . . . , N distributed along a baseline 10 such that each antenna is separated by a constant distance D as illustrated in FIG. 1. Because the signal propagates with a finite velocity, it will in general arrive at the various antennas in the array at different times. It is this time difference of arrival that makes possible beamforming with an array.

A wavefront 12 of signal s(t) defined as s(t=0) will arrive at each antenna within the array at a different time, The signal received by the n'th antenna is given by $$s_n(t)=S(t-\tau_n) \tag{1}$$

where the signal delay $\pi_n$ is given by $$\tau_n = n\frac{D}{c}\sin\theta \tag{2}$$

where D is the element spacing and c is the signal propagation velocity in the transmission medium.

The output of the antenna array without appropriate compensating delays in the antenna signals is given by $$s(t) = \sum_n s_n(t) = \sum_n s(t-\tau_n) \tag{3}$$

as the summation of the signals received by the individual elements. Except for a few trivial cases, this summation alone will yield very poor results. What is needed is a way to align the signals received by the various paths so that they combine in an advantageous way. The optimum solution is to introduce a time delay $\tau'_n$ in each path such that the total delay is the same for all antennas. If this is done, then a beam in the direction of the received signal is formed.

This is the approach taken by true time-delay arrays. Each antenna in the array is followed by an adjustable time delay element that permits a selectable time delay to be applied individually to each antenna signal. If the sum of the imposed time delay $\tau'_n$ and the $\tau_n$ given by equation (2) is the same for all antennas, a beam is formed in the direction θ. The beam direction is not a function of the frequency.

While the implementation of the time-delay unit is beyond the scope of this discussion, generally it involves the introduction of variable-length transmission paths between the antennas and the common junction. Various approaches including switched waveguides, photonic delay lines, multiple reflection cavities, and quasi-optical combining have been proposed. Historically, time-delay units have been difficult or impractical to implement.

As an alternative, narrowband implementations utilizing phase shifters have found greater application. If the incident signal s(t) is made up of a single frequency it is represented mathematically by $$s(t)=e^{j\omega t} \tag{4}$$

where ω is the angular frequency. In this case, the received signal for the n'th antenna is given by $$s_n(t) = e^{j\omega(t-\tau_n)} = e^{j\left(\omega t - n\frac{\omega D}{c}\sin\theta\right)} \tag{5}$$

Thus, in the single-frequency case, the time delay is replaced by a phase shift. Beam forming and steering can now be effectively accomplished by simply introducing a phase-shifting element after each antenna. By selecting a phase shift corresponding to $$\phi_n=(\omega/c)D\sin\theta \tag{6}$$

a beam can be generated in the direction of θ. A variety of phase shifters are known in the art, and numerous examples of phased-array antenna systems are available.

While this approach can be used even when the signal s(t) is is not comprised of a single frequency, degradation does occur in the beam-forming performance. As the frequency varies from ω, the beam is seen to shift or squint. Since the beam produced for a broadband signal is the summation of the individual beams associated with the individual frequency components that make up the beam, a phased array used with broadband signals produces a distorted beam with higher sidelobes.

A final method for beamforming is the use of purely digital beamforming. This method can be viewed as a digital true time-delay beamforming method. In digital beamforming, the received signals are converted from analog to digital and a digital means such as a shift register is used to introduce the required delay. The problems with purely digital beamforming is the need for excessively high-performance digital components such as high speed A/D converters. Of chief concern is the need to sample the received signal at a rate of about three times the carrier frequency. If the signal is not sampled at a high enough rate, the information in the signal will not be preserved by the digital samples. A similar problem arises in the analog-delay method when the delay is produced by a time-delay means having discrete delay times.

Therefore, it would be desirable to have a broadband beamforming apparatus that did not suffer from the serious beam squint and beam broadening of the phase-array antenna but which did not have the complexity or cost of either the analog or digital true time-delay approach. A beamforming method and apparatus for transmitting and receiving arrays such as disclosed here will overcome a longstanding problem in the area of broadband beamforming on high gain (highly directive) arrays for modulated carrier signals.

BRIEF SUMMARY OF THE INVENTION

The invention is a method and apparatus for (1) enhancing the transmission of information in a particular direction or (2) enhancing the reception of information from a particular direction by an array of transducers, a transducer being any device for transforming radiated power into electrical power and vice versa. A transducer signal is associated with each transducer in an array, the plurality of transducer signals being the vehicle for transmitting or receiving information. Each transducer signal is the sum of a first product and a second product. The first product is the product of a first signal and a cosine function of an argument. The second product is the product of a second signal and a sine function of the same argument. An argument is the sum of a phase and a product of an angular frequency and time. The bandwidths of the first and second signals are less than half a reference frequency W, and the angular frequency of the sine and cosine functions is greater than 2π times the reference frequency.

The method comprises the following steps for each transducer signal in the array. The first step consists of adjusting the arguments of the sine and cosine functions. The second step consists of adjusting an embedded time reference in the first and second signals with respect to a real-time reference.

DETAILED DESCRIPTION OF THE INVENTION

Figure 1:
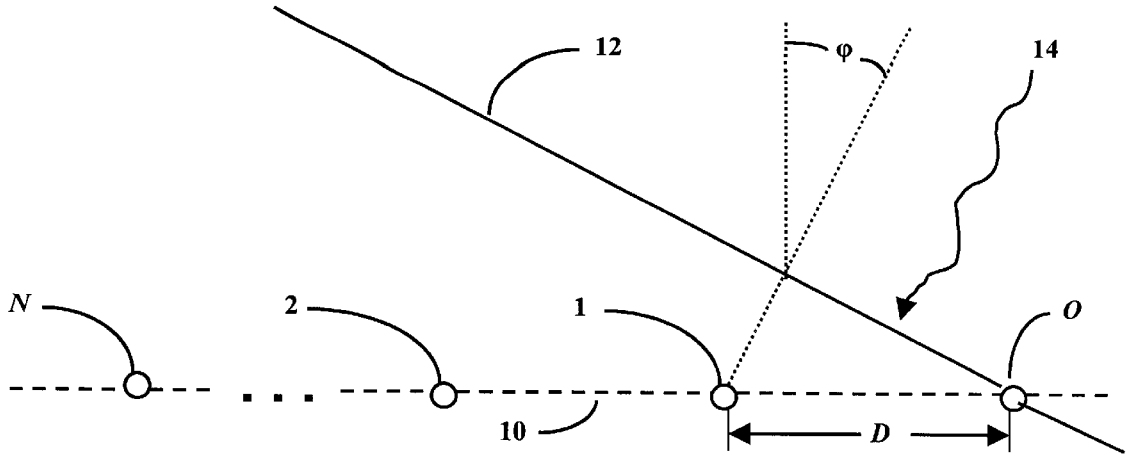
FIG. 1 shows a block diagram of an analog true time-delay array system

The invention is a method and apparatus for enhancing the transmission and reception of information from a particular direction by an array of transducers, a transducer being any device for transforming radiated power into electrical power and vice versa. A transducer signal is associated with each transducer in an array, the plurality of transducer signals being the vehicle for transmitting and receiving information.

The invention employs an array of transducers (e.g. antennas) and for each transducer the heterodyning and phase shifting of carrier signals, and the delaying, weighting and summing of data signals.

The invention is suitable for a wide class of signals employed in radio, TV, radar, sonar and other applications where the signal occupies a limited frequency band and heterodyne processing can be employed. The invention is most advantageous for high gain-bandwidth arrays where the product of the array diameter and the signal bandwidth is greater than the velocity of the radiated signal propagation (speed of light for electromagnetic waves).

For transmission, a set of phase angles, $\{\phi_n\}$, delay values $\{\delta_n\}$, and weights $\{a_n\}$, one threesome for each transducer, are calculated or retrieved from storage, for the specification of the desired main beam direction, direction of nulls (if any) and side-lobe levels (if any). From a carrier signal c(t)(e.g. c=exp(jωt)) common to all transducers a unique phase-shifted carrier signal $c(t)\exp(j\phi_n)$ is generated for each transducer corresponding to the phase angle $\phi_n$ for each transducer. From a data signal d(t) common to all transducers, a unique delayed data signal $d(t-\tau_n)$ is generated for each transducer corresponding to the delay value calculated or retrieved for each individual transducer. In a heterodyne process, a modulator produces the composition (usually multiplication) of the individual phase-shifted carrier and delayed signals. This signal is filtered and amplified, according to the calculated or retrieved weight coefficient $a_n$ to produce the signals $s_n(t)$ applied to each transducer:

$$S_n(t)=a_n \text{band}_{13}\ \text{pass_filter}[d(t-\tau_n)o(c(t)\exp(j\phi_n))] \quad (7)$$

where o is the modulator composition operator.

For reception, the same delayed carrier $c(t-\tau_n)$ is employed to heterodyne the signal $r_n(t)$ sensed by each transducer to a complex baseband signal with in-phase and quadrature components:

$$g_n(t)=\text{low_pass_filter}[r_n(t)o(c(t)\exp(j\phi))] \quad (8)$$

This complex signal is then delayed by $\tau_n$ and weighted by $a_n$.

$$d_n(t)=a_n g_n(t-\tau_n) \quad (9)$$

The complex beam signal is then formed.

$$b(t) = \sum_n d_n(t) \tag{10}$$

and detected in the usual manner (e.g. as $|b(t)|$) to produce the received data signal as is well known in the art.

The phase, delay, and weight parameters are calculated just as they would be for phased and true time-delay arrays known in the art. The advantages of the invention relative to phase and/or true time-delay beamformers are: (1) The phase-shift is applied only to the constant magnitude carrier signal, not to the potentially wide dynamic range transmitted, received, or data signals; (2) the delay is applied to only the relatively narrow-band data signal, not the relatively high frequency transmitted or received signals; and (3) discrete and/or digital approximations are easily applied to achieve efficient discrete and digital processing and control.

The invention is embodied in signal processing apparatus that can be used with a spatial array and that in a transmitting configuration causes the individual transducer signals to be adjusted and in a receiving configuration causes the signals received by the individual array elements to be combined in such a way that the gain of the array as a function of signal direction can be tailored in a variety of ways. The array elements can be radio frequency antennas, acoustic transducers, coherent optical transducers, or any other coherent transducers.

Figure 2:
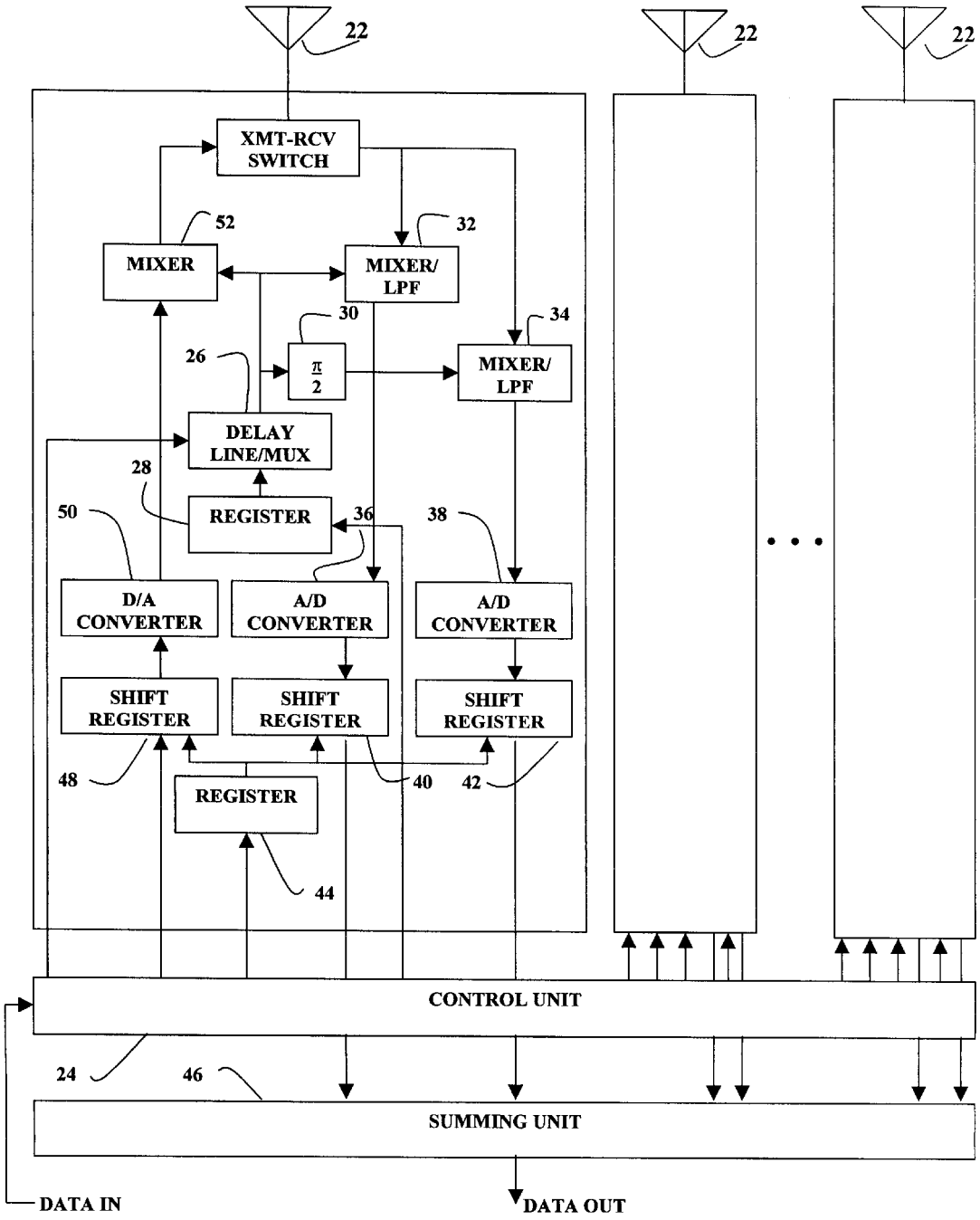
FIG. 2 shows a block diagram for achieving enhanced transmission and reception from a particular direction using an array of antennas or transducers.

A transmitting and receiving configuration of the invention for use with an array of antennas in one embodiment of the invention is shown in FIG. 2. The antenna array is comprised of antennas 22 that are arranged in a one-dimensional, two-dimensional, or three-dimensional spatial array. The antenna elements need not be uniformly spaced, although we assume this below.

One basic idea of the invention is to approximate a transformation of the true time-delay method of beamforming. The approximation is comprised of the discrete sampling and the digital representation of analog values. Various cost and performance tradeoffs are available by choosing various degrees of approximation. The transformation separates the problem of achieving a single true time-delay into two parts, the necessary group time-delay associated with the signal modulation and the phase delay of the carrier needed for coherent beamforming. The phase delay is best accomplished by shifting the carrier frequency and not the antenna signal. The group delay and coherent summing on the other hand, can be most easily accomplished at any desired intermediate or baseband frequency consistent with the modulation bandwidth and independent of the carrier frequency. For this embodiment, baseband is assumed.

Consider a signal s(t) 14 of FIG. 1 emitted (or received) by a distant source (or receiver), as shown above. The output of a true time-delay system, with array elements regularly spaced at a separation of one-half the wavelength of the carrier frequency, for example, will be $$s(t) = \sum_n s_n(t - \tau_n) \tag{11}$$

For a beam steered to a direction θ' and the distant source (or receiver) is at an angle θ, then $$s(t) = \sum_n s_n\left[t - \frac{n}{2f}(\sin\theta - \sin\theta')\right] \tag{12}$$

where $$f = \frac{\omega}{2\pi} \tag{13}$$

Representing the signal s(t) as a modulated carrier signal with d(t) representing the modulation waveform results in $$s(t)=d(t)\exp(j\omega t) \tag{14}$$

$$s(t) = \sum_n d_n\left[t - \frac{n}{2f}(\sin\theta - \sin\theta')\right]\exp(j\varphi_n) \tag{15}$$

where $$\varphi_n = 2\pi f\left[t - \frac{n}{2f}(\sin\theta - \sin\theta')\right]_{mod2\pi} \tag{16}$$

The delay term in $d_n$ need only be accurate enough so as to cause only acceptable distortion in the modulation waveform independent of the carrier frequency. For this example we will choose a maximum error of delay of L/2 carrier cycles. Therefore, L is a parameter for adjusting the degree of approximation. Hence we define an integer $m_n$:

$$m_n = round\left(\frac{n}{L}\sin\theta'\right) \tag{17}$$

Integer $m_n$ is thus a digital control signal that will be used in beam steering. Then $$s(t) = \sum_n d_n\left(t - \frac{n}{2f}\sin\theta + \frac{m_n L}{2f}\right)\exp(j\varphi_n) \tag{18}$$

Thus $d_n$ is shifted in time by L/2 carrier periods for each increment of $m_n$ so that within our chosen digital approximation (parameterized by L) we have approximately, when θ=θ' and if there is no tapering of the array, then $$d_n(t-\tau_n)=d(t) \tag{19}$$

We now have $$s(t) = d(t)\sum_{n=0}^{N} \exp(j\varphi_n) \tag{20}$$

where $$\phi_n=(2\pi ft-\pi n \sin\theta+\pi n \sin\theta')_{mod2\pi} \tag{21}$$

The phase term $\phi_n$ need only be accurate enough so as to cause only acceptable distortion in the beam pattern. The integer P parameterizes the accuracy of the approximation. Therefore we will approximate the necessary phase steering by a digital integer $$k_n=\text{round}[P(n\tau\sin\theta')_{mod2\pi}] \tag{22}$$

so that $$\varphi_n = 2\pi ft - \pi n\sin\theta + k_n \frac{2\pi}{P} \tag{23}$$

$$\exp(j\varphi_n) = \exp(\omega t)\exp\left(jk_n \frac{2\pi}{P} - jn\pi\sin\theta\right) \tag{24}$$

$$s(t) \cong d(t)\exp(j\omega t)\sum_{n=0}^{N} \exp\left(jk_n \frac{2\pi}{P} j\pi\sin\theta\right) \tag{25}$$

Since $k_n$ is chosen to steer the beam to direction θ', when $$\theta=\theta' \tag{26}$$

$$jk_n \frac{2\pi}{P} \cong j\pi\sin\theta \tag{27}$$

so $$s(t)=(N+1)d(t)\exp(j\omega t) \tag{28}$$

and mixing down to baseband $$s(t)\exp(-j\omega t)=(N+1)d(t)\exp(j\omega t-j\omega t)=(N+1)d(t) \tag{29}$$

The modulation signal is recovered from direction θ' where each array element n is controlled by the two integers $m_n$, $k_n$. There can, in some circumstances, be an arbitrary phase shift in the received carrier, just as in other array systems.

To one skilled in the art, it will be seen that the modulation signal can be any of a wide set of choices including pulse amplitude, phase-shift keying, spread spectrum and other waveforms employed in radar, sonar, analog and digital communications and other applications.

In the embodiment shown in FIG. 2, we rearrange the above equations for signal processing convenience and efficiency. In the receiving mode the n'th antenna element 22 will produce the signal $$u_n = d\left(t - \frac{n}{2f}\sin\theta\right)\exp(j\omega t)\exp(-jn\pi\sin\theta) \tag{30}$$

This signal is possibly amplified and down-converted (to baseband in this example) as $$u_n\exp[-j(\omega t + \varphi)_n] = d\left(t - \frac{n}{2f}\sin\theta\right)\exp(-jn\pi\sin\theta)\exp(j\varphi) \tag{31}$$

where $$\phi_n=(2\pi ft-\pi n \sin \theta+\pi n \sin \theta')_{mod 2\pi} \tag{32}$$

as derived above in equation (21). In hardware, this can be easily realized for example, as a tapped delay line/multiplexer 26 with taps spaced at intervals of 2π/P radians at the carrier frequency and selected by an analog (rf) multiplexer controlled by the index $k_n$ supplied by control unit 24 and stored in register 28. We employ a real and imaginary channel to represent the complex baseband signals $$V_{n,r}=u_n \cos (\omega t+\phi_n) \tag{33}$$

$$V_{n,i}=u_n \sin (\omega t+\omega_n) \tag{34}$$

A local oscillator in the control unit 24 produces a carrier signal cos (ωt) that is shifted in phase by delay line/multiplexer 26 to produce cos $(\omega t+\phi_n)$. A π/2-radian phase shifter 30 produces sin $(\omega t+\phi_n)$ from cos $(\omega t+\phi_n)$. These signals are mixed and lowpass filtered in mixer/LPFs 32 and 34 with the signal $u_n$ from the antenna element. The resulting signals are converted by analog-to-digital (A/D) converters 36 and 38 into the two digital data streams representing the real (in-phase) and imaginary (quadrature) parts of the modulation signal, known as the I & Q signals respectively.

The lowpass filters in mixer/LPF's 32 and 34 have a bandwidth that matches the bandwidth of the modulation signal and rejects the carrier signal. The A/D converters 36, 38 sample at a rate compatible with the modulation signal, typically about equal to its bandwidth, and also compatible with aligning the modulation signal $d_n$'s again typically about the bandwidth of the modulation signal. The phase of each antenna element is preserved by the relative signals in the real and imaginary channels.

Next, the proper group delay is applied to the channels by putting the data samples through shift registers 40 and 42 with lengths controlled by the index $m_n$ provided by control unit 24 and stored in register 44 where the A/D sample clock and shift register clock are synchronous with carrier frequency signal and equal f/L, L being chosen to provide the desired precision of beamforming and sampling of the modulation signal. The result is:

$$y_{r,n} = d\left(t - \frac{n}{2f}\sin\theta + \frac{L}{f}m_n\right)\cos\left(k_n \frac{2\pi}{P} - n\pi\sin\theta\right) \tag{35}$$

$$y_{i,n} = d\left(t - \frac{n}{2f}\sin\theta + \frac{L}{f}m_n\right)\sin\left(k_n \frac{2\pi}{P} - n\pi\sin\theta\right) \tag{36}$$

Next we sum the channels from each element in summing unit 46

$$y_r = \sum_n y_{r,n} \tag{37}$$

$$y_i = \sum_n y_{i,n} \tag{38}$$

to produce the final output signal y.

For the case of simple amplitude modulation retain only the magnitude of the result $$y_{mag}=\sqrt{y_{r^2+y_{i^2}}} \tag{39}$$

Then for a source at angle θ and where θ=θ' (i.e. on the beam center)

$$y=(N+1)d(t) \tag{40}$$

within our chosen approximations. Propagation loss, amplifier gains, A/D scaling may scale this result in a hardware system by a constant gain factor.

The beamforming pattern may be determined from $y_r$ and $y_i$ by averaging over the variations in the modulations waveform. Let d be the sampled time index for the A/D converter and D be sufficient samples to average out the modulation. Then the logarithmic beam pattern is $$b(\theta, \theta') = \log_{10}\left[\frac{1}{D}\sum_{d=1}^{D} (y_r^2(d) + y_i^2(d))\right] \tag{41}$$

and if the calculation is carried out, all the approximations as well a the array parameters will be factored into the result.

For the transmittting mode, the receiving mode operations are performed in reverse order. The modulating signal supplied via the control unit 24 is appropriately delayed by shift register 48, converted to analog form by digital-to-analog (D/A) converter 50, and then translated to rf by mixer 52.

The design may be optimized for a particular application by adjusting the approximation parameters L, P and B, the number of A/D digitalization levels as well as the array size N+1 and configuration (uniform or non-uniform, etc.). The beam pattern that results will show degradation when the approximations are too gross.

Figure 3:
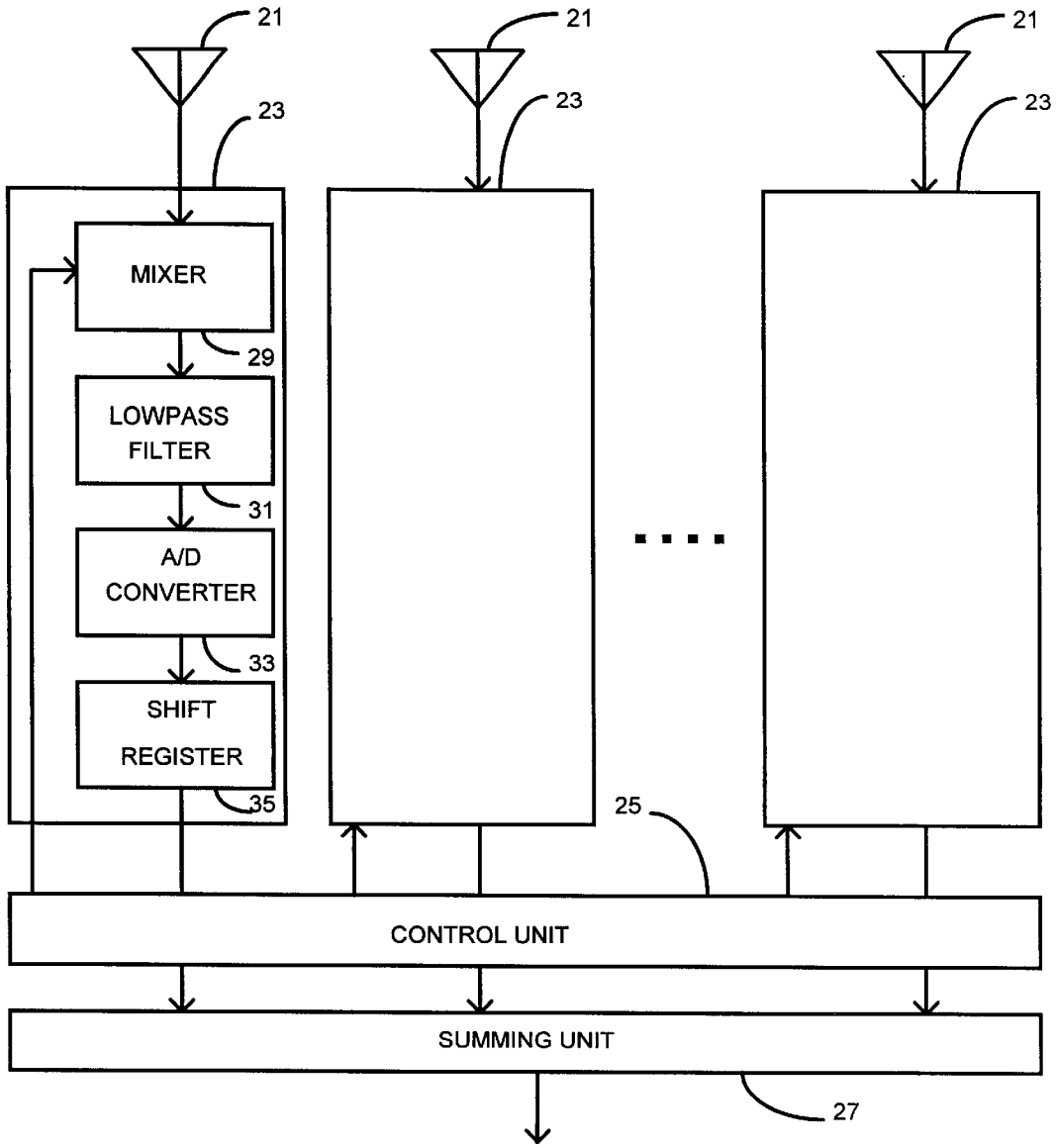
FIG. 3 shows a block diagram for achieving enhanced reception from a particular direction using an array of antennas or transducers.

An embodiment of the invention for receiving arbitrary band-limited waveforms is shown in FIG. 3. The antenna array is comprised of antennas 21 that are arranged in a one-dimensional, two-dimensional, or three-dimensional spatial array. Let us assume that the signal received at some reference point fixed with respect to the array is given by the real part of the complex waveform s(t) which can be expressed in terms of its samples as $$s(t)=\sum_n s\left(\frac{n}{W}\right)\frac{\sin\left[\pi W\left(t-\frac{n}{W}\right)\right]}{\pi W\left(t-\frac{n}{W}\right)}\exp\left[j\omega_0\left(t-\frac{n}{W}\right)\right] \tag{42}$$

where n is an integer and the samples s(n/W) are taken at a sampling rate of W. The spectrum of the signal is assumed to be contained in the frequency interval extending from $\omega_o/2\pi-W/2$ to $\omega_o/2\pi+W/2$. The signal $s_p(t)$ received by the p'th antenna is given by $$s_p(t)=\sum_n s\left(\frac{n}{W}\right)\frac{\sin\left[\pi W\left(t-t_p-\frac{n}{W}\right)\right]}{\pi W\left(t-t_p-\frac{n}{W}\right)}\exp\left[j\omega_0\left(t-t_p-\frac{n}{W}\right)\right] \tag{43}$$

The symbol $t_p$ denotes the time delay of the signal arriving at the p'th antenna relative to the above-mentioned reference point.

Let us express the time delay $t_p$ in terms of the integer $n_p$:

$$t_p=\frac{n_p}{W}+\frac{\delta_p}{W}+\frac{\phi_p}{\omega_0} \tag{44}$$

where $\delta_p+(W/\omega_o)\phi_p$ is a quantity less than one, $(\omega_o/W)\delta$ is an integer times $2\pi$, and the phase $\phi_p$ is less than $2\pi$ radians. Substituting in equation (43) we obtain $$s_p(t)=\sum_n s\left(\frac{n}{W}\right)\frac{\sin\left[\pi W\left(t-\frac{n_p}{W}-\frac{n}{W}-\frac{\delta_p}{W}-\frac{\phi_p}{\omega_0}\right)\right]}{\pi W\left(t-\frac{n_p}{W}-\frac{n}{W}-\frac{\delta_p}{W}-\frac{\phi_p}{\omega_0}\right)}\exp\left[j\omega_0\left(t-\frac{n_p}{W}-\frac{n}{W}-\frac{\delta_p}{W}-\frac{\phi_p}{\omega_0}\right)\right] \tag{45}$$

Replacing $n+n_p+\delta_p$ by m in the above equation we obtain $$s_p(t)=\sum_m s\left(\frac{m-n_p-\delta_p}{W}\right)\frac{\sin\left[\pi W\left(t-\frac{m}{W}-\frac{\phi_p}{\omega_0}\right)\right]}{\pi W\left(t-\frac{m}{W}-\frac{\phi_p}{\omega_0}\right)}\exp\left[j\omega_0\left(t-\frac{m}{W}-\frac{\phi_p}{\omega_0}\right)\right] \tag{46}$$

If $\omega_o$ is significantly greater than W, we can ignore $\phi_p$ in the sinx/x term. If the bandwidth of s(t) is significantly less than W, we can ignore $\delta_p$ in the s term. The above equation then becomes $$s_p(t)=\sum_m s\left(\frac{m-n_p}{W}\right)\frac{\sin\left[\pi W\left(t-\frac{m}{W}\right)\right]}{\pi W\left(t-\frac{m}{W}\right)}\exp\left[j\omega_0\left(t-\frac{m}{W}\right)-j\phi_p\right] \tag{47}$$

Let us now combine the signals from the antennas in the array in the following way to obtain an array output signal $s_o(t)$:

$$s_0(t)=\sum_p A_p D(n_{pd},\phi_{pd})s_p(t) \tag{48}$$

where $A_p$ is a gain factor and $D(n_{pd}, \phi_{pd})$ is an operator which increases the sample number of $s_p(t)$ by $n_{pd}$ and increases the phase by $\phi_{pd}$. We can rewrite equation (48) using equation (47) as $$s_0(t)=\sum_p A_p\sum_m s\left(\frac{m+n_{pd}-n_p}{W}\right)\frac{\sin\left[\pi W\left(t-\frac{m}{W}\right)\right]}{\pi W\left(t-\frac{m}{W}\right)}\exp\left[j\omega_0\left(t-\frac{m}{W}\right)+j(\phi_{pd}-\phi_p)\right] \tag{49}$$

Note that if $n_{pd}=n_p$ and if $\phi_{pd}=\phi_p$, $$s_0(t)=\sum_p A_p\sum_m s\left(\frac{m}{W}\right)\frac{\sin\left[\pi W\left(t-\frac{m}{W}\right)\right]}{\pi W\left(t-\frac{m}{W}\right)}\exp\left[j\omega_0\left(t-\frac{m}{W}\right)\right]=\sum_p A_p s(t) \tag{50}$$

and the array will favor the reception from the direction associated with the given set of $t_p$'s. The gain factors $A_p$ can be assigned values that will minimize the reception of signals from other directions.

The function of each signal processors 23 in FIG. 3 is to apply the operator $D(n_{pd}, \phi_{pd})$ to the antenna signal $s_p(t)$. This operation is conveniently accomplished by first phase-shifting the antenna signal and then associating the sample number with a different sample time. For the purpose of describing the operation of a signal processor 23, we must now phrase the discussion in terms of real, rather than complex, signals. We do this by obtaining a real-signal counterpart of equation (47). Setting the real parts of equation (50) equal to each other, we obtain $$s_{pr}(t)=\sum_m s_r\left(\frac{m-n_p}{W}\right)\frac{\sin\left[\pi W\left(t-\frac{m}{W}\right)\right]}{\pi W\left(t-\frac{m}{W}\right)}\cos\left[\omega_0\left(t-\frac{m}{W}\right)-\phi_p\right]-\sum_m s_i\left(\frac{m-n_p}{W}\right)\frac{\sin\left[\pi W\left(t-\frac{m}{W}\right)\right]}{\pi W\left(t-\frac{m}{W}\right)}\sin\left[\omega_0\left(t-\frac{m}{W}\right)-\phi_p\right] \tag{51}$$

where $$s(t)=s_r(t)+js_i(t) \tag{52}$$

and $s_{pr}(t)$ is the real part of $s_p(t)$.

Introducing the phase shift $\phi_{pd}$ is accomplished by multiplying $s_{pr}(t)$ by a local oscillator signal $2\cos(\omega_{lo}t-\phi_{pd}-\theta)$ supplied by a local oscillator in control unit 25 and lowpass filtering the result. The angular frequency $\omega_{lo}$ is the frequency of the local oscillator. The phase $\theta$ is an arbitrary constant which we will call a facilitating phase in that it aids in the extraction of $s_r(t)$ and $s_i(t)$ from $s_{pr}(t)$.

The multiplication of $s_{pr}(t)$ and 2 cos $(\omega_{hd\ lo}t-\phi_{pd}-\theta)$ is accomplished by mixer 29 and the lowpass filtering by lowpass filter 31. The output signal from the lowpass filter 31 $r_{pr}(t)$ is given by $$r_{pr}(t)=\sum_m s_r\left(\frac{m-n_p}{W}\right)\frac{\sin\left[\pi W\left(t-\frac{m}{W}\right)\right]}{\pi W\left(t-\frac{m}{W}\right)}\cos\left[\omega_{if}\left(t-\frac{m}{W}\right)-(\omega_0-\omega_{if})\frac{m}{W}+(\phi_{pd}-\phi_p)+\theta\right]-\sum_m s_i\left(\frac{m-n_p}{W}\right)\frac{\sin\left[\pi W\left(t-\frac{m}{W}\right)\right]}{\pi W\left(t-\frac{m}{W}\right)}\sin\left[\omega_{if}\left(t-\frac{m}{W}\right)-(\omega_0-\omega_{if})\frac{m}{W}+(\phi_{pd}-\phi_p)+\theta\right] \tag{53}$$

where $\omega_{if}$ is the intermediate frequency and is defined by the equation $$\omega_{if}=\omega_o-\omega_{lo} \tag{54}$$

Requiring $\omega_{lo}/W$ to be an integer and letting $\phi_{pd}=\phi_p$, we obtain $$r_{pr}(t)=\sum_m s_r\left(\frac{m-n_p}{W}\right)\frac{\sin\left[\pi W\left(t-\frac{m}{W}\right)\right]}{\pi W\left(t-\frac{m}{W}\right)}\cos\left[\omega_{if}\left(t-\frac{m}{W}\right)+\theta\right]-\sum_m s_i\left(\frac{m-n_p}{W}\right)\frac{\sin\left[\pi W\left(t-\frac{m}{W}\right)\right]}{\pi W\left(t-\frac{m}{W}\right)}\sin\left[\omega_{if}\left(t-\frac{m}{W}\right)+\theta\right] \tag{55}$$

The above expression for $r_{pr}(t)$ is essentially identical in form to that of antenna signal $s_{pr}(t)$ except that the signal has been translated from an RF frequency $\omega_o$ to an IF frequency $\omega_{if}$, the phase shifts $\phi_p$ resulting from the placement of the antennas in an array have been removed, and the arbitrary phase angle $\theta$ has been introduced.

The information content of the received signals is contained in the signals $s_r(t)$ and $s_i(t)$. To obtain digitized versions of these signals we pass $r_{pr}(t)$ through analog-to-digital converter 33

$$r_{pr}\left(\frac{n}{W}-\frac{\pi}{4\omega_{if}}\right)\cong s_r\left(\frac{n-n_p}{W}\right) \tag{56}$$

We obtain digitized samples of $s_i(t)$ by sampling at times $t_{ns}=n/W+\pi/(4\omega_{if})$:

$$r_{pr}\left(\frac{n}{W}+\frac{\pi}{4\omega_{if}}\right)\cong -s_i\left(\frac{n-n_p}{W}\right) \tag{57}$$

Although the two quantities in the above equations are not precisely equal to each other, reasonably good approximations are obtained for the sampled values of $s_r(t)$ and $s_i(t)$ if $\omega_{if}/W$ is reasonably large.

One can also perform a first mixing-filtering process $M_1$ with $\theta=0$ and a mixing function 2 cos $(\omega_{if}t)$ and a second mixing-filtering process $M_2$ with $\theta=\pi/2$ and the same mixing function. The results are if $\omega_{if}/W$ is an integer $$M_1 r_{pr}(t)=\sum_m s_r\left(\frac{m-n_p}{W}\right)\frac{\sin\left[\pi W\left(t-\frac{m}{W}\right)\right]}{\pi W\left(t-\frac{m}{W}\right)}$$

$$M_2 r_{pr}(t)=-\sum_m s_i\left(\frac{m-n_p}{W}\right)\frac{\sin\left[\pi W\left(t-\frac{m}{W}\right)\right]}{\pi W\left(t-\frac{m}{W}\right)} \tag{58}$$

Sampling at times t=n/W results in $$M_1 r_{pr}\left(\frac{n}{W}\right)=s_r\left(\frac{n-n_p}{W}\right)$$

$$M_2 r_{pr}\left(\frac{n}{W}\right)=-s_i\left(\frac{n-n_p}{W}\right) \tag{59}$$

The sampled values of $s_r(t)$ and $s_i(t)$ are fed into shift register 35 where the sampled values stored in the $q_p$'th stage of the shift register associated with the p'th antenna are denoted by $s_{pr}[(n-n_p-q_p)/W]$ and $s_{pi}[(n-n_p-q_p)/W]$. The quantities read out of the shift register 35 are those for which $n_p+q_p=n_{pmax}+1$ where $n_{pmax}$ is the maximum anticipated value of $n_p$. Thus, the quantities read out of each shift register are $s_{pr}[(n-n_{pmax}-1)/W]$ and $s_{pi}[(n-n_{pmax}-1)/W]$.

The outputs of shift registers 35 are multiplied by $A_p$ and summed by processor 27. The outputs $s_{or}$ and $s_{oi}$ are given by $$s_{0r}=\sum_n A_p s_{pr}[(n-n_{\text{pmax}}-1)/W]$$

$$s_{0i}=\sum_n A_p s_{pi}[(n-n_{\text{pmax}}-1)/W] \tag{60}$$

The values of the weighting factors $A_p$ may be chosen in accordance with well-known procedures to achieve desirable characteristics of the antenna array pattern such as minimizing the sidelobe levels.

Figure 4:
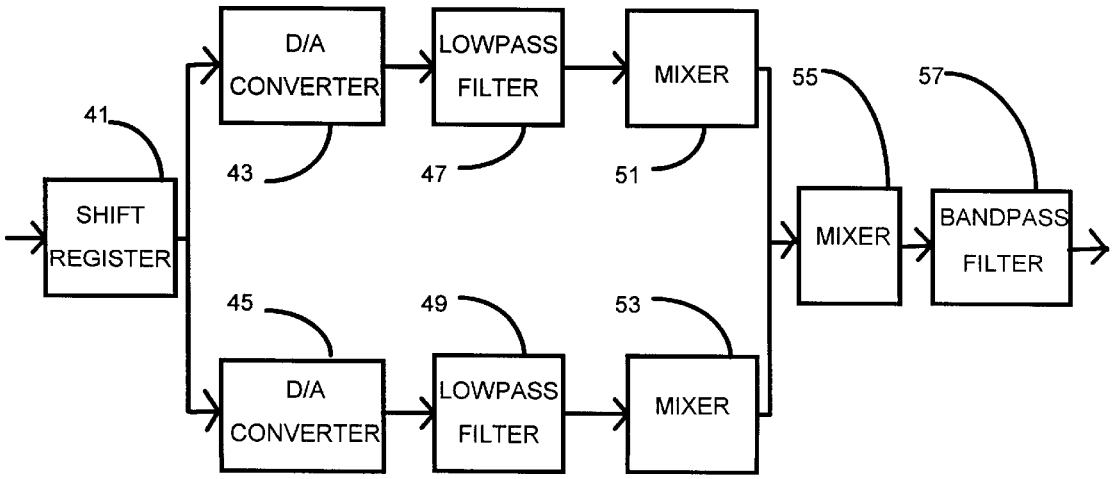
FIG. 4 shows a block diagram for achieving enhanced transmission in a particular direction using an array of antennas or transducers.

We now consider the transmission of a signal in a preferred direction. The block diagram for an antenna processing channel is shown in FIG. 4. The information to be transmitted is contained in the signals $s_{pr}(t)$ and $s_{pi}(t)$, each of bandwidth less than W/2. These signals are represented by sequences of samples $s_{pr}(n/W)$ and $s_{pi}(n/W)$ produced at a rate of W. The sample values $s_{pr}(n/W)$ and $s_{pi}(n/W)$ are fed into shift register 41 where the sample values stored in the $q_p$'th stage of the shift register associated with the p'th antenna are denoted by $s_{pr}[(n-q_p)/W]$ and $s_{pi}[(n-q_p)/W]$. The quantities read out of shift register 41 are those for which $n_{pd}+q_p=n_{pmax}+1$ where $n_{pd}$ is the integer portion of $(Wt_p+\epsilon)$ where $\epsilon$ is preferably equal to ½ but may have any value between 0 and 1 and $n_{pmax}$ is the maximum anticipated value of $n_p$. Thus, the quantities read out of shift register 41 are $s_{pr}[(n+n_{pd}-n_{pmax}-1)/W]$ and $s_{pi}[(n+n_{pd}-n_{pmax}-1)/W]$.

The quantities read out of shift register 41 are converted to analog samples in D/A converters 43 and 45 and then filtered by lowpass filters 47 and 49. The outputs of lowpass filters 47 and 49 are respectively $s_{pr}(t+n_{pd}/W)$ and $s_{pi}(t+n_{pd}/W)$ where we have ignored the constant delay that is independent of the antennas since it is immaterial to the operation of the antenna array.

The signals out of the lowpass filters 47 and 49 are multiplied by cos $(\omega_{if}t+\phi_{pd})$ and $-$sin $(\omega_{if}+\phi_{pd})$ respectively in mixers 51 and 53 and then summed to obtain signal $r_p(t)$ which is given by $$r_p(t) = s_{pr}\left(t + \frac{n_{pd}}{W}\right)\cos(\omega_{if}t + \phi_{pd}) - s_{pi}\left(t + \frac{n_{pd}}{W}\right)\sin(\omega_{if}t + \phi_{pd}) \quad (61)$$

The phase $\phi_{pd}$ is obained by applying the modulo-2π operation to $\omega_o t_{pd}$. This signal is translated to an RF frequency $\omega_o$ by mixer 55 which forms the product of the above signal and 2 cos ($\omega_{lo}$t) and selecting the upper sideband by means of bandpass filter 57. The signal that emerges from bandpass filter 57 and enters an antenna is given by $$r_p(t) = s_{pr}\left(t + \frac{n_{pd}}{W}\right)\cos(\omega_0 t + \phi_{pd}) - s_{pi}\left(t + \frac{n_{pd}}{W}\right)\sin(\omega_0 t + \phi_{pd}) \quad (62)$$

The signal $r_p(t)$ can be reasonably approximated by the signal $s(t+t_{pd})$ where $$s(t)=s_r(t)\cos(\omega_o t)-s_i(t)\sin(\omega_o t) \quad (63)$$

since $n_{pd}/W$ is a close approximation to $t_{pd}$ insofar as the functions $s_r(t)$ and $s_i(t)$ are concerned and $\phi_{pd}$ is the modulo-2π portion of $\omega_o t_{pd}$.

The signal arriving at a receiver is given by $$r_0 = \sum_p A_p s(t + t_{pd} - t_p) \quad (64)$$

where $t_p$ is the additional time required for a signal to travel from the p'th antenna to a particular receiver referenced to the time required for a signal to travel from the antenna array reference point to the receiver. The weighting factor $A_p$ can be applied anywhere in the processing chain and provides the means for obtaining certain desirable characteristics for the antenna array pattern.

By making $t_{pd}=t_p$ for each element, transmission of signals in the direction of the particular receiver is enhanced since the signals received from the array antennas have no delays with respect to one another.

What is claimed is:

1. A method for enhancing the transmission of information in a particular direction or the reception of information from a particular direction by an array of transducers, a transducer being any device for transforming radiated power into electrical power and vice versa, a transducer signal being associate with each transducer in the array, the plurality of transducer signals being the vehicle for transmitting or receiving information, each transducer signal being the sum of a first product and a second product, the first product being the product of a first signal and a cosine function of an argument, the second product being the product of a second signal and a sine function of the same argument, an argument being the sum of a phase and a product of an angular frequency and time, the bandwidths of the first and second signals being less than half a reference frequency W, th angular frequency of the sine and cosine functions being greater than 2π times the reference frequency, the method comprising the following steps for each transducer signal in the array:

(a) obtaining a first control parameter and adjusting the arguments of the sine and cosine functions by an amount governed by the first control parameter;

(b) obtaining a second control parameter and adjusting an embedded time reference in the first and second signals with respect to a real-time reference by an amount governed by the second control parameter.

2. The method of claim 1 further comprising the step:

(c) adjusting the amplitude of a transducer signal.

3. The method of claim 1 wherein step (a) comprises the step:

(a1) adjusting the angular frequency of the sine and cosine functions.

4. The method of claim 1 wherein step (a) comprises the step:

(a1) adjusting the phase of the sine and cosine components.

5. The method of claim 1 wherein step (a) comprises the steps:

(a1) determining the difference in propagation times $t_p$ between a receiver or transmitter and the p'th transducer and a reference point associated with the array;

(a2) adjusting the phase of the sine and cosine functions by the change in the argument modulo-2π of the sine or cosine components over a time interval equal to $t_p$.

6. The method of claim 1 wherein step (b) comprises the steps:

(b1) obtaining samples of the first and second signals that comprise the p'th transducer signal, the n'th sample being obtained at time n/W;

(b2) associating the n'th sample with time $(n+n_{pd})/W$ thereby obtaining an adjustment of the embedded time reference with respect to a real-time reference, $n_{pd}$ being an integer of either sign associated with the p'th transducer.

7. The method of claim 1 wherein step (b) comprises the steps:

(b1) determining the difference in propagation times $t_p$ between a receiver or transmitter and the p'th transducer and a reference point associated with the array;

(b2) adjusting the embedded time reference for the first and second signals by the integer portion of the quantity $(Wt_p+\epsilon)$ in units of 1/W, the quantity $\epsilon$ being a number between 0 and 1.

8. The method of claim 1 wherein the transmission of information in a particular direction is enhanced, the component parts of a transducer signal being the same for each transducer, the adjusted transducer signal or the adjusted transducer signal translated to another frequency band being transmitted by the p'th transducer, the adjusted transducer signal being the signal obtained after performing steps (a) and (b) on the component parts of the p'th transducer signal.

9. The method of claim 8 wherein step (a) and step (b) are performed prior to forming the first product and the second product.

10. The method of claim 8 wherein step (b) is performed prior to forming the first product and the second product and step (a) is performed after forming the first product and the second product.

11. The method of claim 1 wherein the reception of information from a particular direction is enhanced, the p'th transducer signal being the signal received by the p'th transducer or the signal received by the p'th transducer translated to another frequency band.

12. The method of claim 11 wherein step (b) is performed after step (a), step (b) comprising the steps:

(b1) separately extracting the first and second signals from a transducer signal;

(b2) adjusting the embedded time reference in the first and second signals with respect to a real-time reference.

13. The method of claim 11 wherein step (b) is performed after step (a), step (b) comprising the steps:

(b1) separately extracting the first an second signals from a transducer signal after performing step (a);

(b2) obtaining samples of the first and second signals at the reference frequency;

(b3) obtaining digital representations of the samples of the first and second signals;

(b4) adjusting the embedded time reference in the first and second signals with respect to a real-time reference.

14. The method of claim 11 wherein step (b) is performed after step (a), step (b) comprising the steps:

(b1) obtaining samples of the first signal by sampling a transducer signal after performing step (a) at first-signal times, first-signal time being the times when the first product is the predominant contributor to the transducer signal amplitude;

(b2) obtaining samples of the second signal by sampling a transducer signal after performing step (a) at second-signal times, second-signal times being the times when the second product is the predominant contributor to the transducer signal amplitude.

15. The method of claim 11 wherein step (a) comprises the steps:

(a1) multiplying a transducer signal by one or more cosine-function multipliers, each cosine-function multiplier having an argument that is the sum of an adjustment phase and the product of an angular frequency and time;

(a2) convolving each of the one or more results of step (a1) with an impulse response characteristic of a filter that rejects angular frequencies that are either less than or greater than the angular frequencies of the transducer-signal cosine and sine functions.

16. The method of claim 15 wherein step (a1) is performed with only one cosine-function multiplier and step (b) is performed after step (a), step (b) comprising the steps:

(b1) obtaining samples of the first signal by sampling an a transducer signal after performing step (a) at first-signal times, first-signal times being the times when the first product is the predominant contributor to the transducer signal amplitude;

(b2) obtaining samples of the second signal by sampling a transducer signal after performing step (a) at second-signal times, second-signal times being the times when the second product is the predominant contributor to the transducer signal amplitude.

17. The method of claim 15 wherein step (a1) is performed with a first cosine-function multiplier and a second cosine-function multiplier, the adjustment phase included in the argument of the first cosine-function multiplier being comprised of a compensating phase and a first facilitating phase, the adjustment phase included in the argument of the second cosine-function multiplier being comprised of the compensating phase and a second facilitating phase, step (b) being performed after step (a), step (b) comprising the steps:

(b1) obtaining samples of the first signal by sampling a transducer signal processed with the first cosine-function multiplier;

(b2) obtaining samples of the second signal by sampling the transducer signal processed with the second cosine-function multiplier.

18. Apparatus for practicing the method of claim 1.

19. Apparatus for enhancing the transmission of information in a particular direction or the reception of information from a particular direction by an array of transducers, a transducer being any device for transforming radiated power into electrical power and vice versa, a transducer signal being associated with each transducer in the array, a first control parameter and a second control parameter being associated with each transducer in the array, the plurality of transducer signals being the vehicle for transmitting or receiving information, each transducer signal being the sum of a first product and a second product, the first product being the product of a first signal and a cosine function of an argument, the second product being the product of a second signal and a sine function of the same argument, an argument being the sum of a phase and a product of an angular frequency and time, the bandwidths of the first and second signals being less than half a reference frequency W, the angular frequency of the sine and cosine functions being greater than $2\pi$ times the reference frequency, the apparatus comprising for each transducer signal in the array:

a phase-shifting unit for adjusting the arguments of the sine and cosine functions in accordance with the value of a first control parameter;

a time delay unit for adjusting an embedded time reference in the first and second signals with respect to a real-time reference in accordance with the value of a second control parameter.

20. The apparatus of claim 19 further comprising:

a signal scaling unit for adjusting the amplitude of the transducer signal.

21. The apparatus of claim 19 wherein the phase-shifting unit comprises:

a frequency translator for adjusting the angular frequency of the sine and cosine functions.

22. The apparatus of claim 19 wherein the phase-shifting unit adjusts the phase of the sine and cosine components.

23. The apparatus of claim 19 wherein the phase-shifting unit is supplied with the difference in propagation times $t_p$ between a receiver or transmitter and the p'th transducer and a reference point associated with the array, the phase-shifting unit adjusting the phase of the sine and cosine functions by the change in the argument modulo-$2\pi$ of the sine or cosine components over a time interval equal to $t_p$.

24. The apparatus of claim 19 wherein the time delay unit comprises:

a sampling circuit for obtaining samples of the first and second signals that comprise the p'th transducer signal, the n'th sample being obtained at time n/W;

a processing circuit for associating the n'th sample with time $(n+n_{pd})/W$ thereby obtaining an adjustment of the embedded time reference, with respect to a real-time reference, $n_{pd}$ being an integer of either sign associated with the p'th transducer.

25. The apparatus of claim 19 wherein the time delay unit is supplied with the difference in propagation times $t_p$ between a receiver or transmitter and the p'th transducer and a reference point associated with the array, the time delay unit adjusting the embedded time reference for the first and second signals by the integer portion of the quantity $(Wt_p+\epsilon)$ in units of 1/W, the quantity $\epsilon$ being a number between 0 and 1.

26. The apparatus of claim 19 wherein the transmission of information in a particular direction is enhanced, the component parts of a transducer signal being the same for each transducer, the adjusted transducer signal or the adjusted transducer signal translated to another frequency band being transmitted by the p'th transducer, the adjusted transducer signal being the signal obtained after adjusting the arguments of the sine and cosine functions and after adjusting an embedded time reference in the first and second signals with respect to a real-time reference.

27. The apparatus of claim 19 wherein the reception of information from a particular direction is enhanced, the p'th transducer signal being the signal received by the p'th transducer or the signal received by the p'th transducer translated to another frequency band.

28. The apparatus of claim 27 wherein the time delay unit comprises:

a signal extraction unit for extracting the first and second signals from a transducer signal, the time delay unit adjusting the embedded time reference in the first and second signals with respect to a real-time reference.

29. The apparatus of claim 27 wherein the time delay unit comprises:

a signal extraction unit for extracting the first and second signals from a transducer signal;

a sampling circuit for obtaining samples of the first and second signals at the reference frequency;

an analog-to-digital converter for obtaining digital representations of the samples of the first and second signals, the time delay unit adjusting the embedded time reference in the first and second signals with respect to a real-time reference.

30. The apparatus of claim 27 wherein the time delay unit comprises:

a sampling circuit for (1) obtaining samples of the first signal by sampling a transducer signal at first-signal times and (2) obtaining samples of the second signal by sampling the transducer signal at second-signal times, first-signal times being the times when the first product is the predominant contributor to the transducer signal amplitude, second-signal times being the times when the second product is the predominant contributor to the transducer signal amplitude.

31. The apparatus of claim 27 wherein the phase-shifting unit comprises:

a frequency translator that multiplies the transducer signal by one or more cosine-function multipliers and convolves each of the one or more resulting products with an impulse response characteristic of a filter that rejects angular frequencies that are either less than or greater than the angular frequencies of the transducer-signal cosine and sine functions, each cosine-function multiplier having an argument that is the sum of an adjustment phase and the product of an angular frequency and time.

32. The apparatus of claim 31 wherein the frequency translator multiplies the transducer signal by only one cosine-function multiplier, the time delay unit comprising:

a sampling circuit for (1) obtaining samples of the first signal by sampling the transducer signal at first-signal times and (2) obtaining samples of the second signal by sampling the transducer signal at second-signal times, first-signal times being the times when the first product is the predominant contributor to the transducer signal amplitude, second-signal times being the times when the second product is the predominant contributor to the transducer signal amplitude.

33. The apparatus of claim 31 wherein the frequency translator multiplies the transducer signal by a first cosine-function multiplier and a second cosine-function multiplier, the adjustment phase included in the argument of the first cosine-function multiplier being comprised of a compensating phase and a first facilitating phase, the adjustment phase included in the argument of the second cosine-function multiplier being comprised of the compensating phase and a second facilitating phase, the time delay unit comprising:

a sampling circuit for (1) obtaining samples of the first signal by sampling the transducer signal processed with the first cosine-function multiplier and (2) obtaining samples of the second signal by sampling the transducer signal processed with the second cosine-function multiplier.

* * * * *